US005271377A

United States Patent [19]

Rouleau

[11] Patent Number: 5,271,377

[45] Date of Patent: Dec. 21, 1993

[54] RANGE HOOD VALVE UNIT

[76] Inventor: Gilles L. Rouleau, 1185, Cherbourg, St.-Hubert, Quebec, J3Y 6G5, Canada

[21] Appl. No.: 656,582

[22] Filed: Feb. 19, 1991

[51] Int. Cl.[5] ..... F24C 15/20

[52] U.S. Cl. ..... 126/299 R; 126/299 D; 251/326

[58] Field of Search ..... 251/326; 98/41.3, 40.26; 126/299 R, 299 D

[56] References Cited

U.S. PATENT DOCUMENTS 1,488,229 3/1924 Burns ..... 251/326

3,918,471 11/1975 Bedner ..... 251/326

4,783,048 11/1988 Clair ..... 251/326

*Primary Examiner*—Carroll B. Dority

*Attorney, Agent, or Firm*—Roland L. Morneau

[57] ABSTRACT

A sliding valve unit is adapted to be mounted on the exit panel of a range hood in front of an exit duct. The valve unit is made of a pair of flat plates facing each other. The pair of plates have a perforation therethrough and a sliding slice therebetween for obstructing the perforation. A handle connected to the slice extends between the plates and outwardly for manually moving the slice. The valve unit is provided with means for being fixed flatwise against said duct.

11 Claims, 6 Drawing Sheets 62
56
66
60
61
62
58
61
67
63
80
84
86
59
70
4
4
5
5
6
6
7
7
8
8

40
70
56
66
72
67
63
62

40
70
70
72
76
59
56
60
66
62
76
67
78

62
56
63

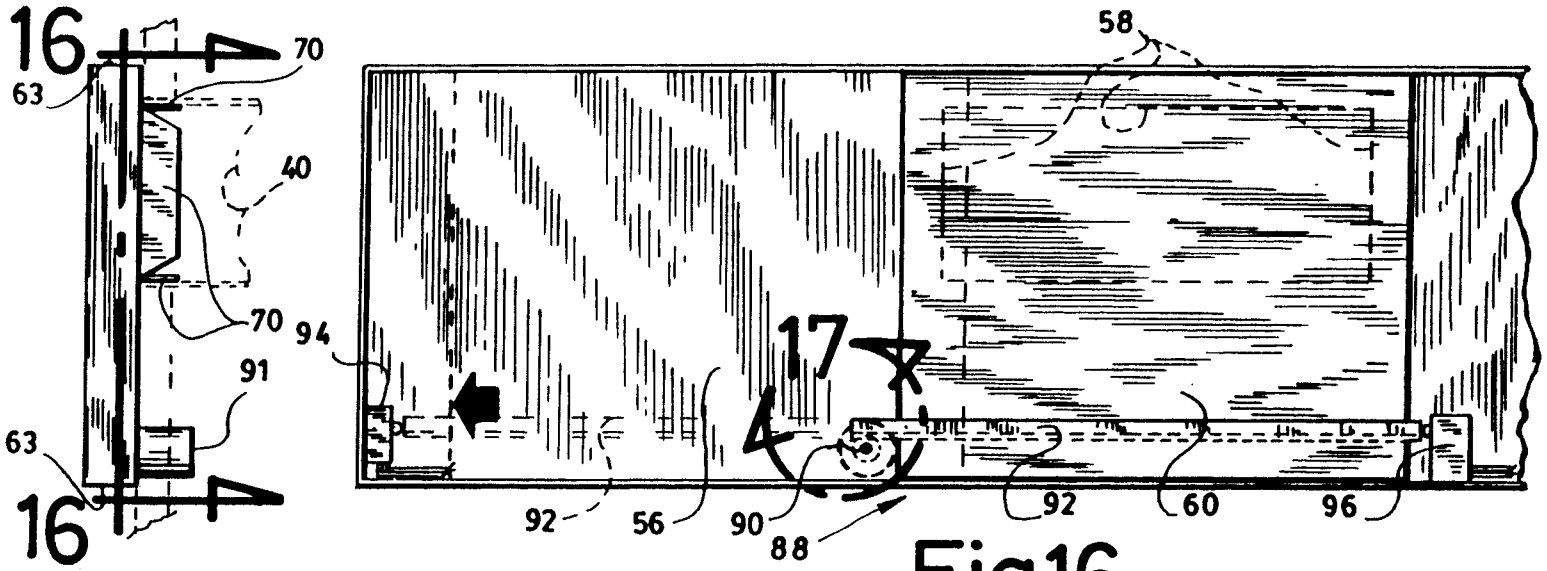
Fig.16
Fig.15
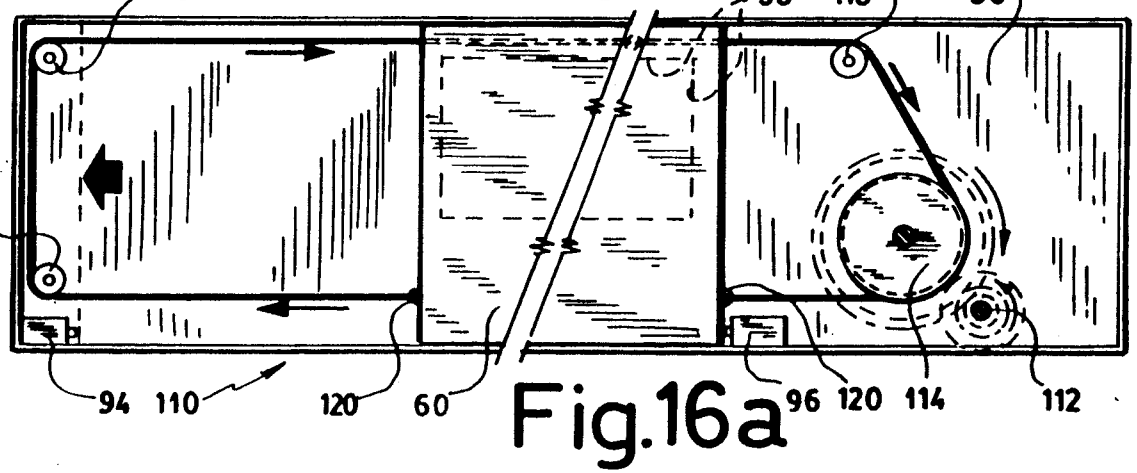
Fig.16a
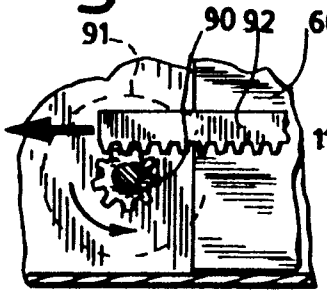
Fig.17

RANGE HOOD VALVE UNIT

FIELD OF THE INVENTION

This invention relates to a ventilating range hood accessory and more particularly to a valve type unit which will allow the user to selectively seal off the outlet orifice on the discharge side of the hood's blower assembly in order to minimize heat loss when the outlet orifice discharges outside of the building where the range hood is located.

BACKGROUND OF THE INVENTION

Range hoods are commonly installed in an horizontal position, spaced above a cooking stove in order to remove the undesirable particles and odors inherent to the cooking operations. The volatile products are drawn into the hood by a draft of air induced by a fan or blower before being pushed through a discharge orifice. Two basic types of range hood discharge orifice have been used in the past namely ducted and ductless. With the ductless hood the air is first filtered and is then returned through a vent at the top of the hood. The more commonly used ducted hood is provided with an outlet orifice which is connected to a duct that discharges the air outside of the room and in most instances outside of the building.

With the ducted hood connected to a duct which discharges outside of the building, a flap assembly acting as a one way valve is commonly used at the final point of discharge to prevent outside air from entering the building when the blower assembly is inoperative. However, experience has clearly demonstrated that such flap assembly are often inefficient in keeping outside air from entering the building because variations in the pressure differential between air outside of the building and inside of the room where the hood is located cause the flap to rattle and open randomly. The variations in the pressure differential are induced by a variety of factors such as variations in the wind intensity, opening of doors inside the building, the use of heating devices and so forth. In geographical regions where there exists a temperature differential between the air outside of the building and the air inside the room where the hood is located, the flap assembly is thus considered a potential source of considerable energy waste. Furthermore, since it is located at the final point of discharge outside of the building it is difficult to maintain and service and thus losses even more of its efficiency as the outside elements such as rain, snow or the like degrade its structure and alter its efficiency.

Some range hoods such as the one disclosed in the U.S. Pat. No. 4,266,527 make use of a damper 42 which are centrally suspended. These dampers are noisy because they are constantly flipping whenever they are subjected to a small circulation of air. For this reason, Barnhart et al, in the above mentioned patent, proposes felt strips to prevent the metal to metal contact. Such dampers are not very effective as energy savers. Furthermore, the damper 42 as well as the damper 27 requires a longitudinal space along the duct because they rotate about a transversal axle. Such a space is not always available in duct for range hood. In some cases, a damper such as 27 is liable to obstruct the free circulation of air when the ducts are set at an angle.

SUMMARY OF THE INVENTION

The present invention therefore relates to a range hood valve unit which circumvents the above mentioned disadvantages by providing a structure adapted to completely seal-off the air passage between the discharge opening of the range hood and the final point of discharge of the duct independently of pressure differential variations.

A sliding valve unit for a range hood which has a flat exit panel provided with a rectangular opening allowing air circulation between the hood and an exit duct, comprises a pair of flat plates facing each other, provided with a perforation therethrough substantially corresponding and facing the opening of the panel. A flat slice is slidingly mounted between the plates, has a contour larger than the aperture and is adapted to close the latter when facing it. Means such as a handle is connected to the slice and extends between the plates for sliding the slice in front and away from the perforation. Means such as adhesive tape is used to fix the valve unit flatwise on the exit panel. Accordingly the slice, when positioned in front of the aperture, stops air from circulating between the hood and the exit duct.

The proposed structure is relatively thin, i.e. about ½ to ¾ inch thick. It occupies a minimal amount of space and can be therefore can be readily mounted on existing hoods by displacing the latter by a distance equal to the thickness of the valve unit. It can also be incorporated in the design of future hoods without the need to modify the conventional method of installation of range hoods. Furthermore, the present invention relates to a structure which can be easily and readily operated by the user. The structure being located adjacent to the hood, it is easier to service and maintain than the existing flap assembly.

The new valve unit can also be electrically operated and connected in combination and in sequence with the fan of the range hood.

DESCRIPTION OF THE DRAWING

FIG. 15 is the side view of the valve unit, FIG. 16 is a cross-sectional view taken along line 16—16 of FIG. 15 illustrating an alternative embodiment of the invention whereby a rack and pinion assembly automatically opens and shuts off the valve, FIG. 16*a* illustrates another alternative embodiment of FIG. 16 whereby a pulley system automatically opens and shuts off the valve, FIG. 17 is a close up detailed view of the connection between the rack and pinion illustrated by encircled portion 17 in FIG. 16, FIGS. 18, 19 and 20 are schematic electrical diagrams for operating the valve unit shown in FIG. 16.

DETAILED DESCRIPTION OF THE INVENTION

Figure 1:
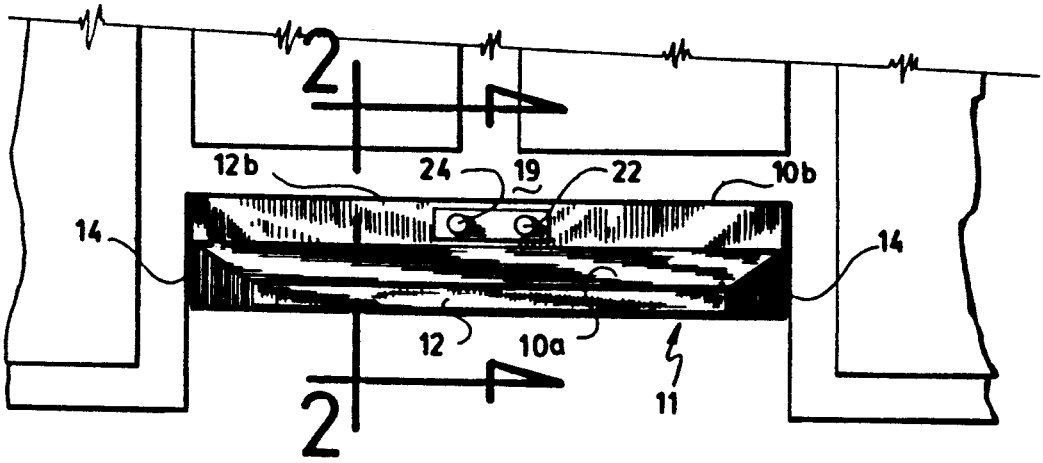
FIG. 1 is a schematic front view of a range hood mounted underneath a kitchen cabinet.
Figure 2:
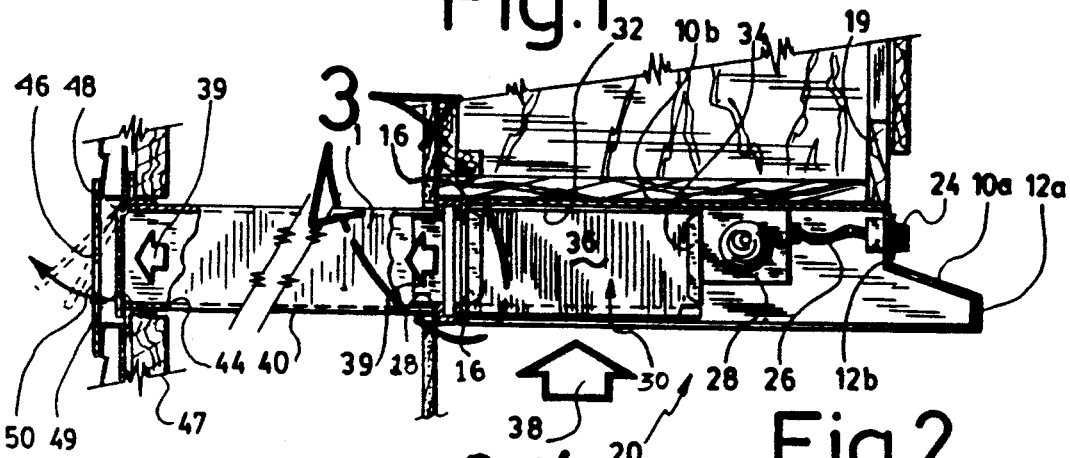
FIG. 2 is a cross-sectional view taken along line 2—2 of FIG. 1 showing a duct attached to the range hood and discharging outside of the building.
Figure 3:
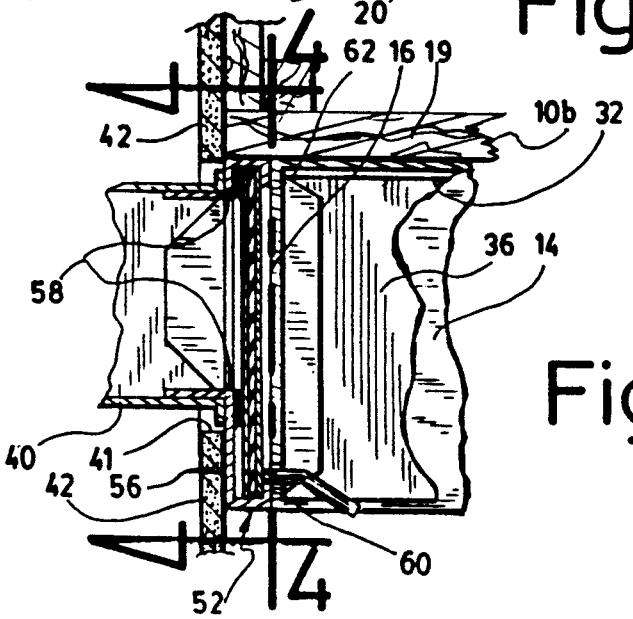
FIG. 3 is a close-up detailed view of the encircled portion 3 in FIG. 2 illustrating the connection between an outlet orifice of the range hood valve unit according to the invention, and the duct.

Referring to the drawings and more particularly to FIGS. 1 and 2 is shown a range hood 11 comprising top panels 10*a* and 10*b*, front panels 12*a* and 12*b*, side panels 14 and a back panel 16. The back panel 16 is provided with a rectangular opening 18. The panels 10*a*, 10*b*, 12, 14 and 16 form a box-like structure 20 open at the bottom which is suitably dimensioned for mounting to an overhang, such as the bottom of a kitchen cabinet 19.

An on-off light switch 22 and a fan speed control switch 24 are provided on panel 12*b*. As shown on FIG. 2, the speed control switch 24 is electrically linked by a cable 26 to an electric motor 28 which drives a fan (not shown). A light or lights (not shown in the drawings) electrically linked to switch 22 can be conveniently located within the hood 11, such as adjacent to side panels 14. The fan is located inside an inner compartment 30 bounded at the top by a panel 32 at the front by a panel 34 at the sides by panels 36 and open at the back and at the bottom.

The fan is so located as to effectively draw air represented by arrows 38 in FIG. 2 from below the hood 10 and to push it along arrows 39 through the rectangular opening 18 leading to a duct 40 which originates at an opening 41 located through an interior wall 42. The duct 40 discharges through an opening 44 provided in an exterior wall 47 of the building.

The conventional means for preventing outside air from entering inside the building through the duct 40 when the fan is inoperative is illustrated in FIG. 2 by a flap 46 adapted to pivot about a hinge 48 and to close-off the final orifice 49 of the discharge of the duct 40. A grid or meshing 50 is conventionally provided to prevent outside debries such as leaves or animals such as birds from entering the duct 40 when the flap 46 is an open position.

As stated previously, the flap 46 is often inefficient in keeping outside air from entering the building because of variations in the pressure differential between air outside the building and air inside the room where the hood is located. The present invention is adapted to circumvent the above-mentioned disadvantages by providing a valve type device 52 which completely seals off the opening and which is unaffected by pressure differentials.

The valve-type device 52 comprises a pair of flat plates 54 and 56 facing each other in adjacent and parallel planes. The plates 54 and 56 are provided with a pair of apertures 58 there-through adapted to be substantially aligned with the rectangular opening 18 in the back panel 16. The plates 54 and 56 being spacedly mounted relative to each other, define a sliding volume 59 in which a flat slice 60 having a contour 61 larger than aperture 58 is slidingly mounted. The slice 60 is adapted to close the aperture 58 thus preventing air from circulating between hood 11 and the duct 40.

Figures 4, 5, 6, 7:
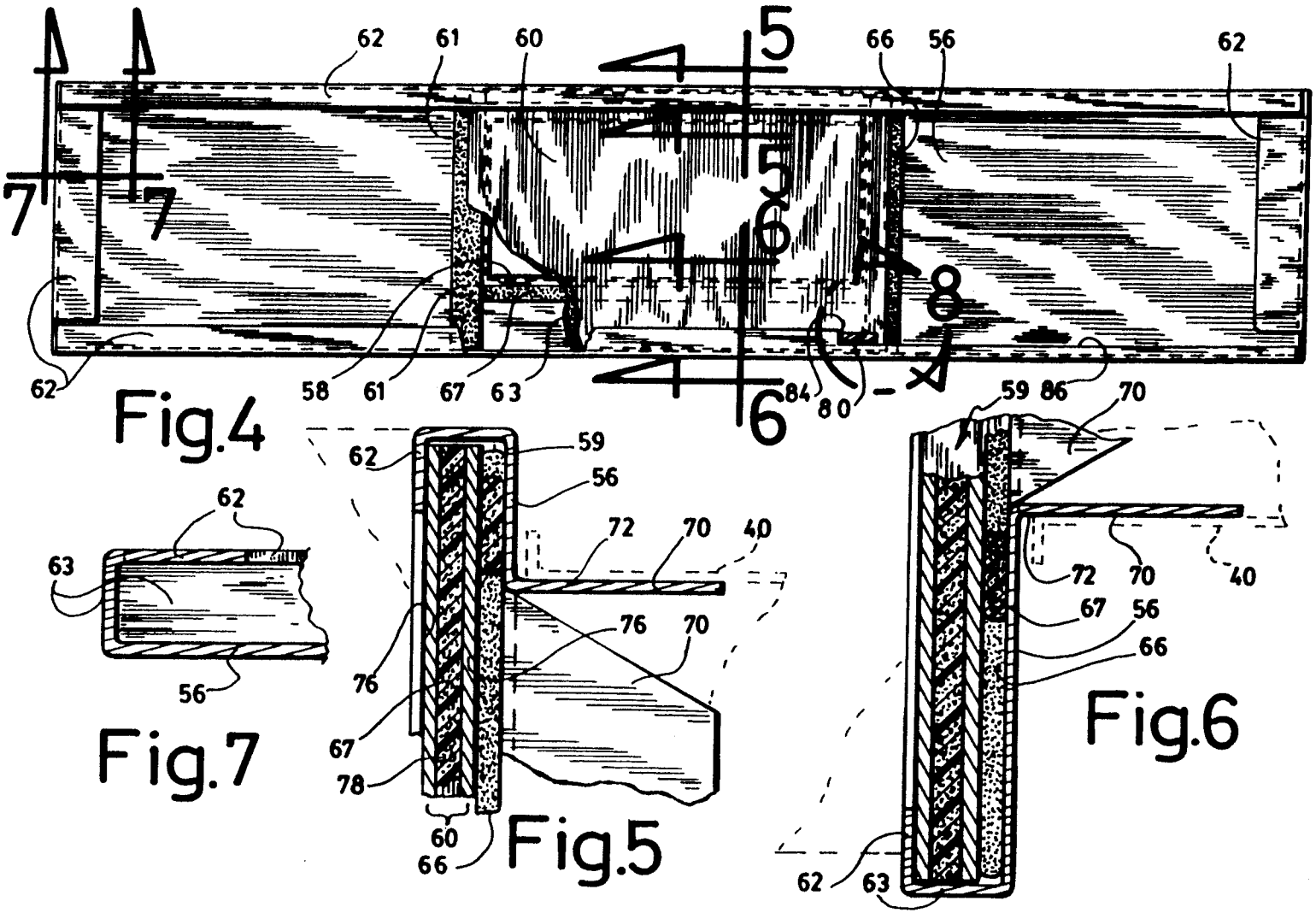
FIG. 4 is a elevational view of the interior of the valve unit taken along line 4—4 of FIG. 3.
FIG. 5 is a cross-sectional detailed view taken line 5—5 of FIG. 4.
FIG. 6 is a cross-sectional detailed view taken along line 6—6 of FIG. 4.
FIG. 7 is a detailed cross-sectional view of a corner of the valve unit taken along line 7—7 of FIG. 4.
Figure 8:
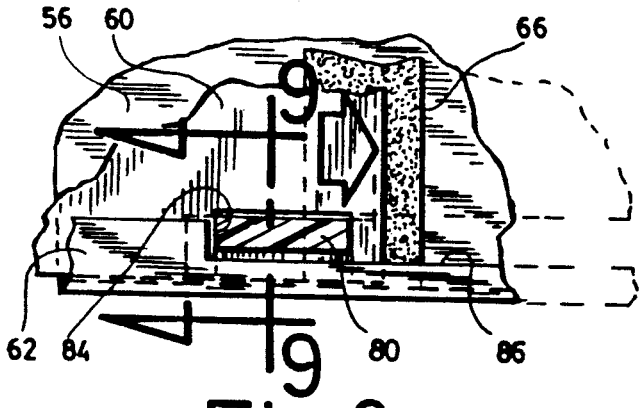
FIG. 8 is an enlarged detailed view of the handle illustrated in encircled portion 8 of FIG. 4.
Figure 9:
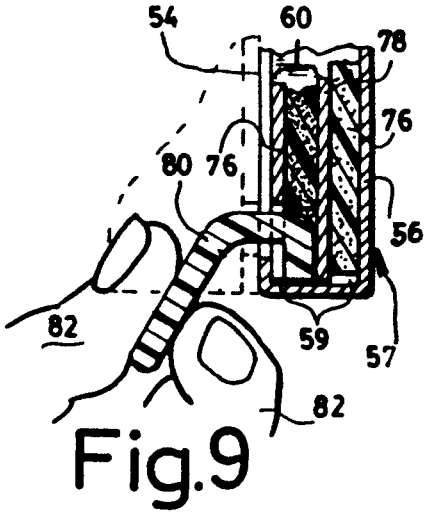
FIG. 9 is a cross-sectional view taken along line 9—9 of FIG. 8.
Figure 10:
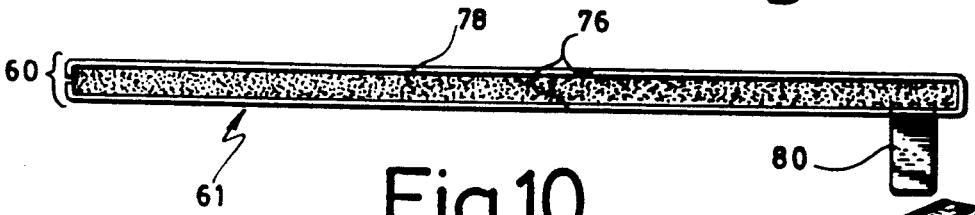
FIG. 10 is a longitudinal cross-sectional view of a sliding plate part of the valve unit.
Figure 11:
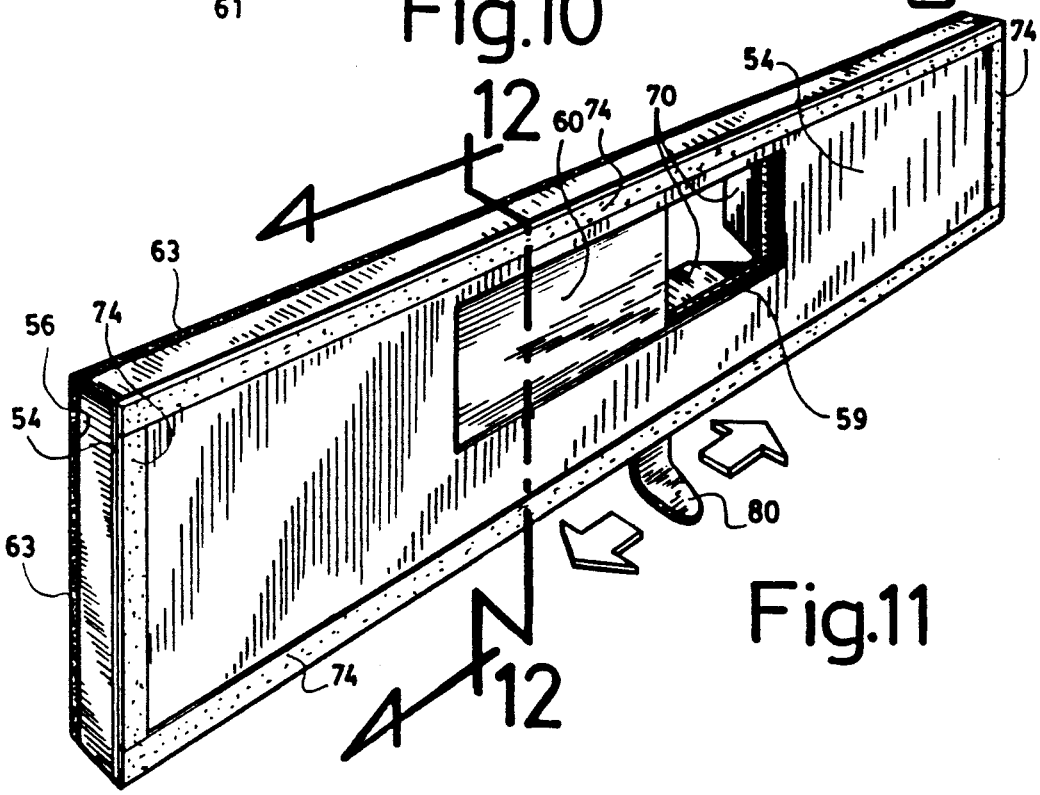
FIG. 11 is a perspective view of a valve unit having a handle attached to the bottom of a slice.
Figure 14:
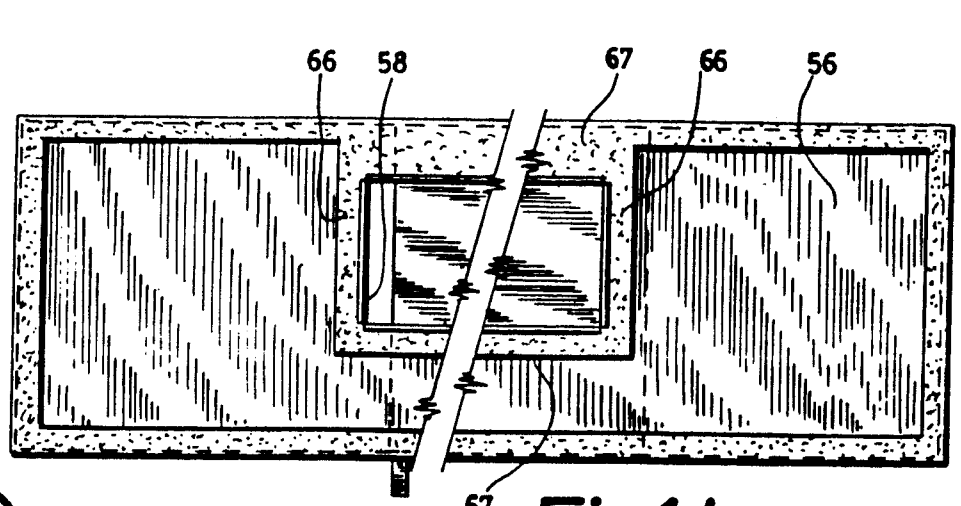
FIG. 14 is a front view of the back panel of the valve unit.
Figure 13:
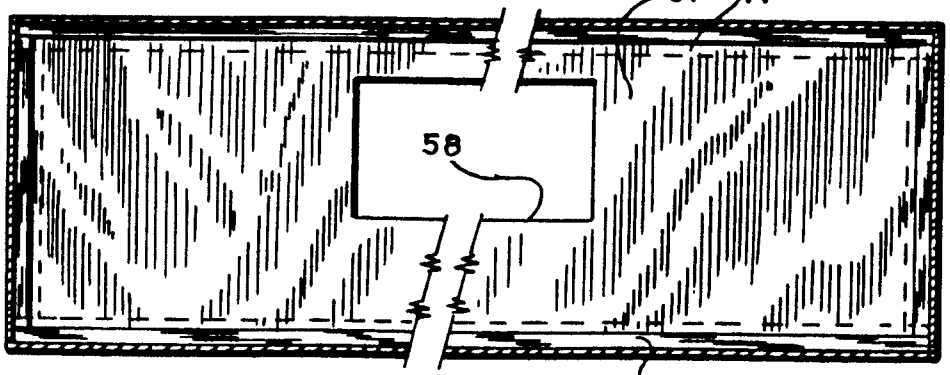
FIG. 13 is a cross-sectional view of the valve unit taken along line 13—13 of FIG. 12.
Figure 12:
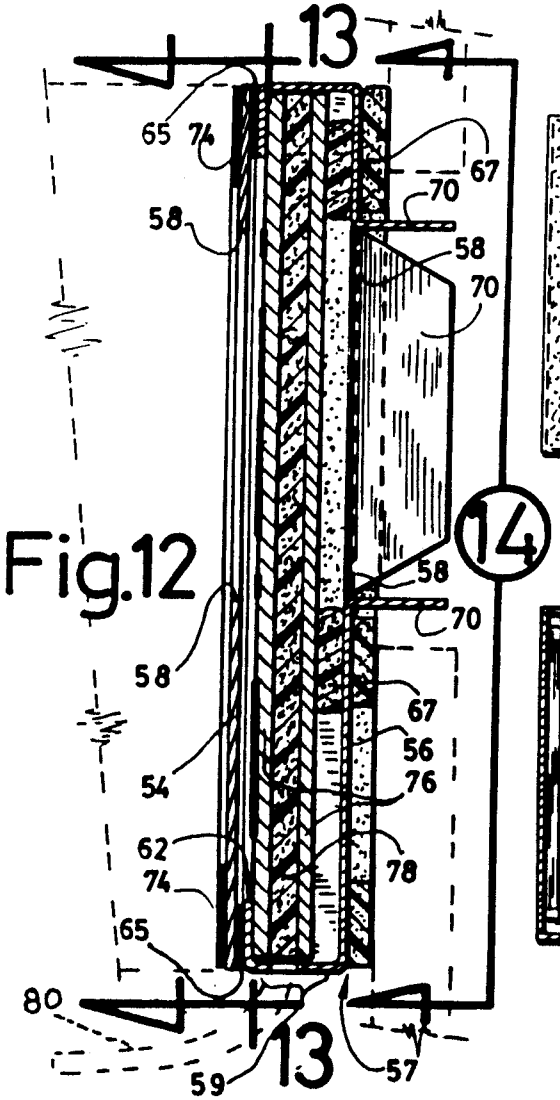
FIG. 12 is a transversal cross-sectional view of the valve unit taken along line 12—12 of FIG. 11.

Plate 56 is cut-out and folded in such a fashion that it defines peripheral ledges and marginal flaps 62. The retaining marginal flaps 62 are adapted to keep plate 54 in a space relationship with plate 56. Plates 54 and 56 thus define a relatively flat box-like structure 57 (see FIG. 9). Plate 54 is secured to retaining flaps 62 by suitable means such as welding spots or adhesive strips 65 (FIG. 12). A plurality of sealing means such as vertical foam strips 66 and horizontal foam strips 67 are peripherally mounted on plate 56 around aperture 58 thus preventing metal to metal contact and providing a good sealing action with the slice 60. A double pair of connecting fins 70 adapted to serve as linking means with duct 40 extend integrally from the edges 72 of aperture 58 in both plates 54 and 56. The connecting fins 70 are made up of flonges folded out of plate 56. As mentioned previously, the invention can either be incorporated in the design of future hoods or manufactured as a separate unit which is adaptable to existing. In instances where the invention is manufactured as a separate unit, a strip of adhesive material such as double sided adhesive tape 74 is provided around the periphery of plate 54 to serve as fixing means. The use of the sliding slice 60 as means for sealing of the passage of air in particularly appropriate for this type of application since it allows for an overall relatively thin valve type device 52 which can thus be readily installed on existing hoods. The valve 52 can easily and readily be positioned between the interior wall 42 and the hood 10 with only a small forward displacement of the hood. The thinness of the valve 52 also allow for easy integration in the design of future hoods without modifications to the basic structure of conventional hoods. In such new hoods, the valve is simply positioned inside the hood adjacent the rearward most wall of the hood. The slice member 60 is preferably manufactured from a piece of metal 76 (FIG. 10) folded to provide an enclosure for a layer of spongy and insulating material 78 such as felt, foam or the like acting as damping means against vibrations and as heat insulating means. A handle 80 is connected to the bottom of the slice 60 (FIG. 14). The handle extends from between the plates 54 and 56 and protrudes outside the box-like structure 57. The user merely grabs the handle 80 between its fingers 82 as illustrated in FIG. 9, and slides the slice 60 in order to open or seal-off the aperture 58. The handle 80 is adapted to abut against an edge 84 of a recess 86 (FIG. 4) in the retaining flap 62 when the slice 60 seals-off the aperture 58.

In two alternative embodiments of the invention, the slice 60 is mechanically moved between open and closed positions by an automatic system linked to the fan on-off switch 24.

Referring now more specifically to FIG. 16, the first of these alternative embodiments uses a rack and pinion assembly 88 comprising a rack 92 fixedly secured to the slice 60 and a pinion wheel 90 mounted on a motor 91 fixed to plate 56. A recess is provided in the wall 42 to receive the motor 91. The rack 92 abuts against a microswitch 94 when the aperture 58 is open and against a microswitch 96 when the aperture 58 is sealed off.

Figure 18:
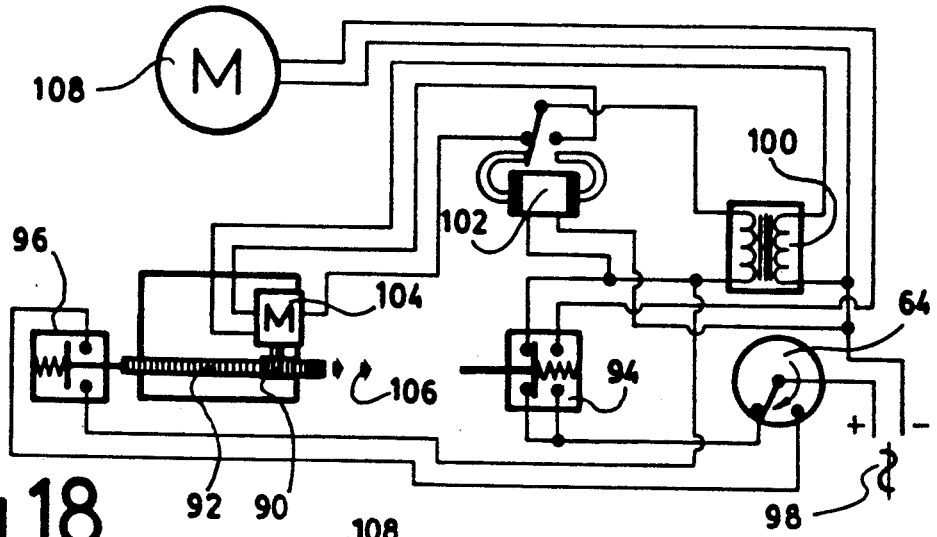
Figure 18A:
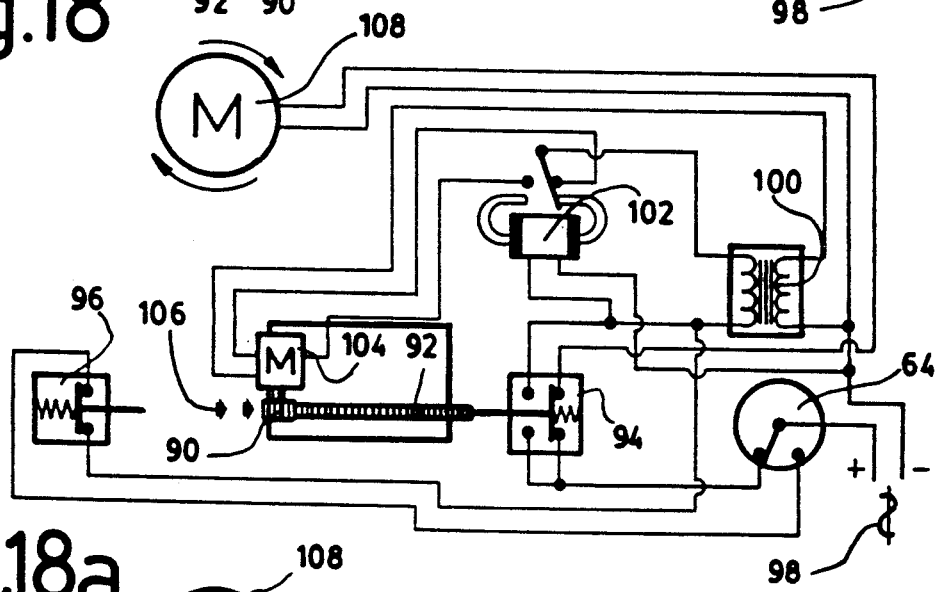
Figure 18B:
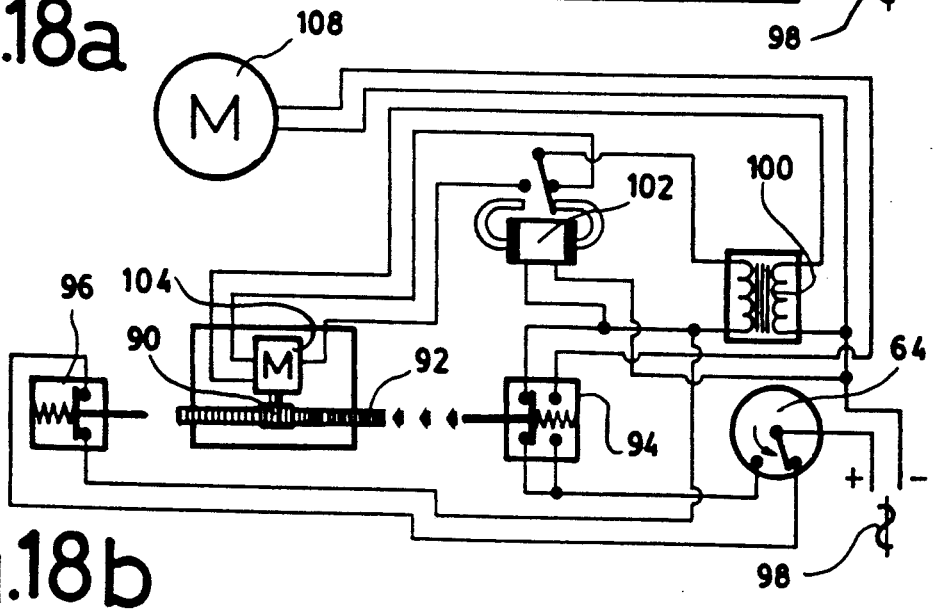

The movement of the rack and pinion assembly 88 is controlled by an electrical circuit schematized in FIGS. 18, 18*a* and 18*b*.

FIG. 18 illustrates a situation whereby the slice 60 originally seals off the aperture 58 and the fan is inoperative. Upon the rotation of the fan on-off switch 64 to the "on" position of the current emanating from a power source 98 is directed by microswitch 94 first to a transformer 100 adapted to reduce the voltage and then through a relay 102 towards a small motor 104 which drives pinion wheel 90. Upon rotation of the pinion wheel 90, the rack 92 and slice 60 to which is attached, translates as illustrated by arrows 106, until the aperture 58 is opened and the rack 92 comes into contact with the microswitch 94. As illustrated in FIG. 18*a*, microswitch 94 then directs the shut-off current to the small motor 104 and directs it towards motor 108 which drives the fan. When the on-off switch 64 is turned back to its "off" position as illustrated in FIG. 18*b*, current to the motor 108 is shut off and redirected through transformer 100 to the small motor 104 which actuates the rack and pinion assembly 88 to its original position whereby the microswitch 96 opens the electrical circuit and aperture 58 is sealed-off.

Referring now to FIG. 16*a*, the second embodiment for automatically moving the slice 60 between the open and closed position, comprises a belt and pulley arrangement 110 having a driving wheel 112 which actuates a belt wheel 114. A belt 116 maintained under tension by tension-wheels 118 is anchored on both sides of slice 60 by hooking means 120. An electrical system similar the one used in the previous embodiment is adapted to control the driving wheel 112 allowing movements of the slice 60 between the two microswitches 94 and 96.

I claim:

1. A sliding valve unit for range a hood having a flat back panel provided with a rectangular opening therethrough, said opening allowing air circulation between said hood and an exit duct, said valve unit comprising a pair of flat plates facing each other, one of said pair of plates adapted to face and lie against said panel, said pair of plates being provided with an aperture therethrough substantially corresponding in size with said opening, said aperture being adapted to face said opening, a flat slice slidingly mounted between said plates, said slice having a contour larger than said aperture and adapted to close the latter when facing it, means connected to said slice and extending between said plates for sliding said slice in front and away from said aperture, and means for fixing said valve unit flatwise on said back panel, whereby said slice, when positioned in front of said aperture, stops air from circulating between said hood and said exit duct.

2. A sliding valve unit as recited in claim 1, wherein said flat plates are spacedly mounted to allow said slice to move freely therebetween, sealing means peripherally mounted on one of said plates around said aperture.

3. A sliding valve unit as recited in claim 2, wherein said slice comprises two superposed panels and a layer of insulating material mounted between, said insulating material adapted to reduce vibrations of said slice caused by ventilation.

4. A sliding valve unit as recited in claim 3, wherein said insulating material is a spongy foam rubber adapted to allow said panels to slidingly abut on said sealing means.

5. A sliding valve unit as recited in claim 4, wherein one of the flat plates is adapted to be located adjacent said duct and provided with flanges around said aperture, said flanges adapted to be fittedly introduced in said duct.

6. A sliding valve unit as recited in claim 2, comprising driving means for sliding said slice, motor means for actuating said driving means, and sensor means for alternately changing the direction of said slice.

7. A sliding valve unit as recited in claim 6, said sensor means compromises a micro-switch located at both ends of the travel distance of the slice.

8. A sliding valve unit as recited in claim 6, wherein the driving means comprise a toothed rack fixed on said slice and a pinion mounted on one of said plates for engaging said rack.

9. A sliding valve unit as recited in claim 7, wherein the driving means comprise a set of pulleys and a belt passed around said pulleys for rotating the latter, the ends of said belt being fixed at both ends of the slice, said motor means adapted to actuate one of said pulleys for pulling on said slice in alternate direction.

10. A valve unit as recited in claim 2 comprising a toothed rack fixed on said slice and a pinion mounted on one of said plates for engaging said rack.

11. A sliding valve unit as recited in claim 2, comprising a set of pulleys and a belt passed around said pulleys for rotating the latter, the ends of said belt being fixed at both ends of the slice.

* * * * *